US006601952B2

(12) United States Patent
Sugioka et al.

(10) Patent No.: US 6,601,952 B2
(45) Date of Patent: Aug. 5, 2003

(54) RECORDING APPARATUS

(75) Inventors: Hideyuki Sugioka, Ebina (JP); Masami Amemiya, Tokyo (JP); Hajime Yamamoto, Yokohama (JP); Kenji Shinjo, Yokohama (JP); Toshihiko Bekki, Yokohama (JP); Fumitaka Goto, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/838,280

(22) Filed: Apr. 20, 2001

(65) Prior Publication Data

US 2002/0001027 A1 Jan. 3, 2002

(30) Foreign Application Priority Data

Apr. 28, 2000 (JP) ..... 2000-129360

(51) Int. Cl.[7] ..... B41J 2/01
(52) U.S. Cl. ..... 347/104; 400/188
(58) Field of Search ..... 347/104, 38; 400/188, 400/654, 656, 655, 657, 658; 399/364

(56) References Cited

U.S. PATENT DOCUMENTS 5,475,412 A * 12/1995 Wong ..... 347/104
6,296,405 B1 * 10/2001 Brewington et al. ..... 400/188
6,341,838 B1 * 1/2002 Miyauchi ..... 347/37
6,471,351 B1 * 10/2002 Ishikawa et al. ..... 347/104

FOREIGN PATENT DOCUMENTS

| | | |
|---|---|---|
| JP | 61-59911 | 12/1986 |
| JP | 61-59912 | 12/1986 |
| JP | 61-59913 | 12/1986 |
| JP | 61-59914 | 12/1986 |
| JP | 9-327950 | 12/1997 |
| JP | 10-76713 | 3/1998 |

* cited by examiner

*Primary Examiner*—Hai Pham
*Assistant Examiner*—Ly T Tran
(74) *Attorney, Agent, or Firm*—Fitzpatrick, Cella, Harper & Scinto

(57) ABSTRACT

A recording apparatus includes a conveying device for conveying a recording medium, a recording rotary unit in which a recording device for recording an image on the recording medium and a recording medium holding device for supporting the recording medium with respect to the recording device are opposed to each other, and a rotating device for rotating the recording rotary unit.

8 Claims, 5 Drawing Sheets

RECORDING APPARATUS

BACKGROUND OF THE INVENTION

1. Field of the Invention

The present invention relates to a recording apparatus for performing recording on both sides of a recording medium.

2. Related Background Art

Various types of recording apparatuses have been proposed and put into practical use. For example, there are impact type, laser beam type, thermal transfer type, and ink-jet type recording apparatuses.

The ink-jet recording system, in which recording is performed by ejecting ink droplets onto a recording medium, is advantageous in that it allows high-speed recording, provides high recording quality, and performs recording with a low noise level. Further, this system makes it possible to easily perform color image recording and to record on ordinary paper. Furthermore, it easily allows a reduction in apparatus size.

Generally speaking, a recording apparatus using this ink-jet recording system is equipped with a recording head having ejection outlets for ejecting ink as flying ink droplets, ink flow passages communicating with the ejection outlets, and energy generating means provided in a part of the ink flow passages and adapted to impart ejection energy to the ink in the ink flow passages.

For example, Japanese Patent Publication Nos. 61-59911, 61-59912, 61-59913, and 61-59914 disclose methods in which an electrothermal converting member is used as the energy generating means and in which heat energy generated by applying an electric pulse thereto is caused to act on ink to thereby eject the ink.

In the recording system disclosed in the above-mentioned publications, heat energy acts on ink to generate a bubble in the ink, and, by an acting force due to a rapid expansion of this bubble, ink is ejected from the ejection outlets at the forward end of the recording head portion, the ejected ink droplets adhering to a recording medium to thereby perform image recording. In this system, it is possible to arrange ejection outlets in the recording head in high density, so that it is possible to record a high-resolution, high-quality image at high speed, and the system is applicable as information output means in a copying machine, printer, facsimile apparatus, etc.

As examples of a recording apparatus capable of automatically performing recording on the back side or both sides of a recording medium, there are available, for example, a system as disclosed in Japanese Patent Application Laid-open No. 9-327950, in which a recording medium is reversed, and a system as disclosed in Japanese Patent Application Laid-open No. 10-76713, in which a recording head is arranged on either side of a recording medium.

However, in the system in which the recording medium is reversed, the mechanism for reversing the recording medium might be complicated, and the reversing of the recording medium takes a long time, resulting in an increase in recording time. On the other hand, the system in which a recording head is arranged on either side of the recording medium involves an increase in the number of parts, resulting in an increase in production cost.

SUMMARY OF THE INVENTION

It is an object of the present invention to provide at low cost a recording apparatus capable of performing image recording on the back side or both sides of a recording medium automatically and at high speed.

Another object of the present invention is to provide a recording apparatus including conveying means for conveying a recording medium, a recording rotary unit in which a recording means for recording an image on the recording medium and a recording medium holding means for supporting the recording medium with respect to the recording means are opposed to each other, and rotating means for rotating the recording rotary unit.

DESCRIPTION OF THE PREFERRED EMBODIMENTS

Embodiments of the present invention will now be described with reference to the drawings.

First Embodiment

Figure 1:
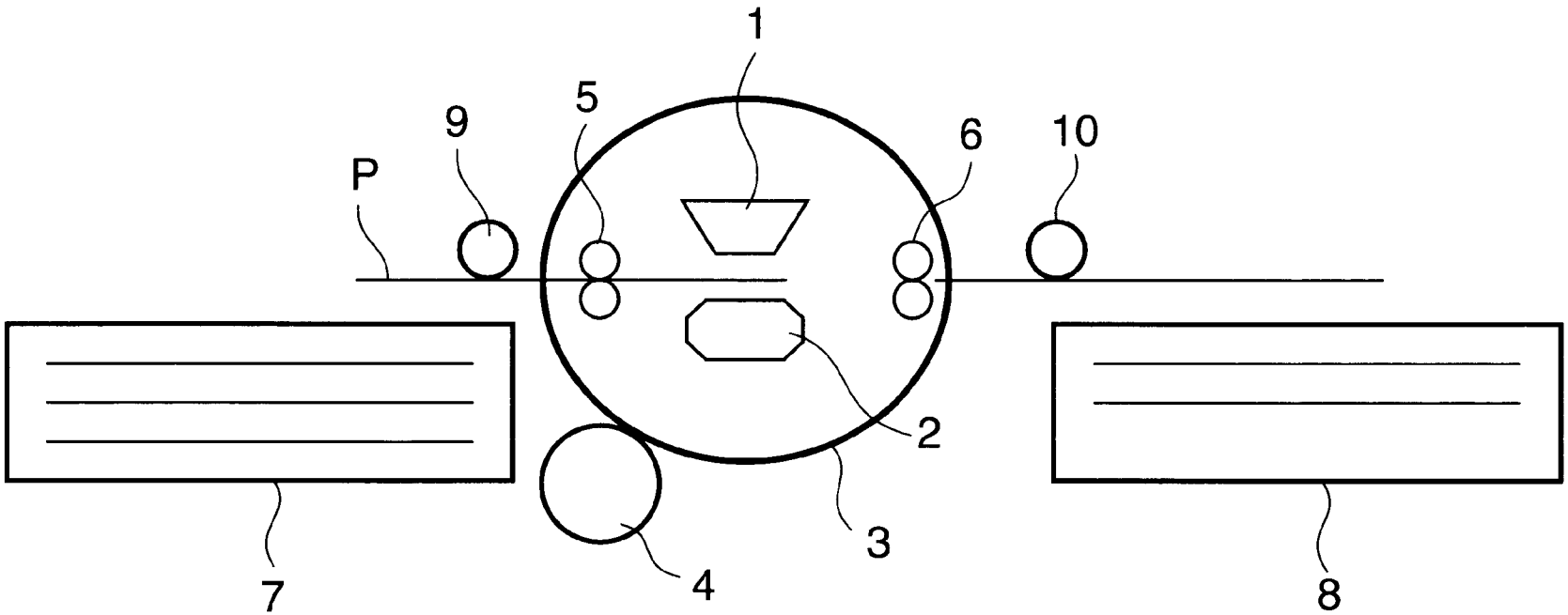
FIG. 1 is a schematic sectional view of a recording apparatus according to a first embodiment of the present invention.
Figure 2A:
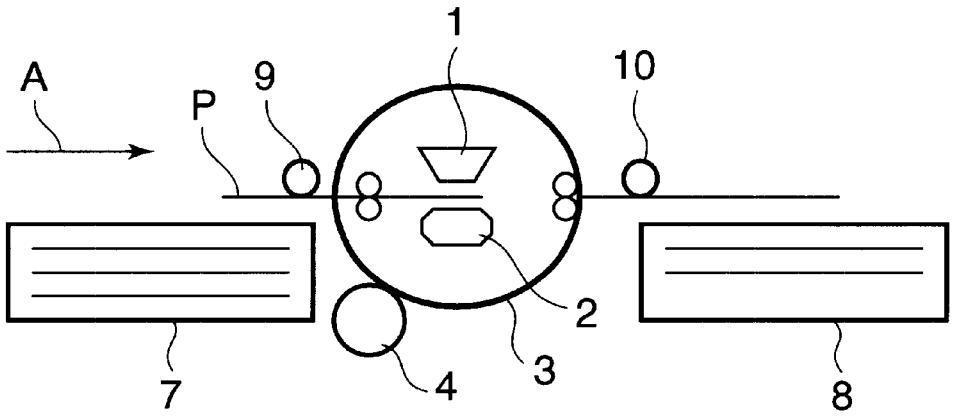
FIGS. 2A and 2B are diagrams illustrating a both-side recording operation.
Figure 2B:
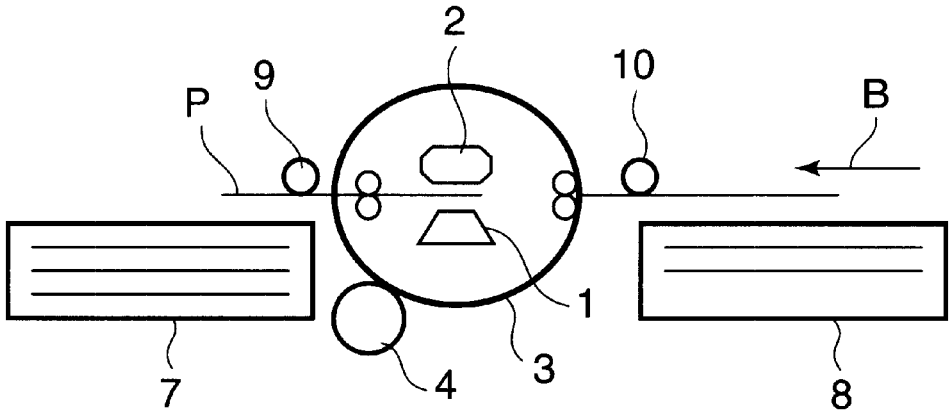

A recording apparatus according to the first embodiment of the present invention will be described with reference to the drawings. FIG. 1 is a schematic diagram showing a recording apparatus according to the first embodiment of the present invention, and FIGS. 2A and 2B are diagrams illustrating a both-side recording operation. First, the construction of the apparatus will be described, and then the both-side recording operation will be described.

As shown in FIG. 1, the recording apparatus of this embodiment has a recording rotary unit 3 in which a recording head 1 serving as the recording means and a recording medium holding means 2 are opposed to each other. The recording rotary unit 3 can be rotated by a unit rotating means 4. By rotating the recording rotary unit 3 by approximately 180 degrees as described below, the recording surface of the recording medium can be switched from a first to a second surface.

On either side of the recording rotary unit 3, there is provided a sheet loading means 7, 8 on which recording mediums P are loaded, each sheet loading means being provided with a rotation roller 9, 10 serving as a recording medium conveying means. The rotation rollers 9 and 10 convey and discharge the recording medium P with respect to the recording rotary unit 3 and also constitute a reversal conveying means which reverses the conveying direction of the recording medium discharged from the recording rotary unit 3 and conveys them again to the recording rotary unit 3.

Inside the recording rotary unit 3, there are provided auxiliary conveying means 5 and 6 serving as auxiliary recording medium conveying means consisting of conveying rollers or spurs. Thus, in this embodiment, the recording rotary unit 3 is composed of the recording head 1, the recording medium holding means 2, and the auxiliary conveying means 5 and 6. The provision of the auxiliary conveying means 5 and 6 in the recording rotary unit 3 makes it possible to smoothly drag the recording medium into the recording rotary unit 3 even when there is a minute positional deviation at the time of reversing the rotary unit. Further, it makes it possible to convey the recording medium to the exterior of the recording rotary unit 3.

The recording means of the present invention may employ any of the following systems: an ink-jet system, an impact system, a laser beam system using toner, and a thermal transfer system. Further, the recording medium is not restricted to paper and OHP sheet. It may also be a sheet of cloth, metal, glass, etc. Regarding the recording material, there are no particular restrictions in the present invention as long as it enables an image to be recorded. The recording material may be water-color ink, oil ink, toner or the like.

Next, the operation of recording images on both sides of a recording medium will be described with reference to FIGS. 2A and 2B. First, when performing recording on the first surfaces of the recording mediums, each recording medium P is conveyed from the sheet loading means 7 in the direction indicated by an arrow A by means of the rotation roller 9, and fed to the recording rotary unit 3 as shown in FIG. 2A. And, an image is recorded by the recording head 1 on the recording medium P passing over the recording medium holding means 2, and the recording medium is discharged toward the sheet loading means 8 by the rotation roller 10. As shown in the drawing, at this time, the recording head 1 is positioned above the recording medium P, and the recording medium holding means 2 is positioned under this recording medium P.

When the recording on the first surface of the recording medium is completed, the recording rotary unit 3 is rotated, as shown in FIG. 2B, by approximately 180 degrees by the unit rotating means 4, whereby the recording rotary unit 3 is positioned under the recording medium P, and the recording medium holding means 2 is positioned above the recording medium P. In this condition, the conveying direction of the rotation roller 10 is reversed, and the recording medium is again conveyed toward the recording rotary unit 3 in the direction as indicated by an arrow B. After an image is recorded on the lower surface, that is, on the second surface, of the recording medium, the recording medium is discharged onto the sheet loading means 7 by the rotation roller 9.

Due to the above-described construction, it is possible to record an image on both sides of a recording medium by a single recording means, without reversing the recording medium. In the conventional construction in which an image is recorded on both sides of a recording medium by reversing the recording medium, each recording medium should be handled carefully, which means it is difficult to realize a high-speed recording. In this embodiment, in contrast, the operation of rotating the recording means is relatively easy, so that it is possible to reduce the requisite time for reversal, thus achieving an increase in recording speed.

Second Embodiment

Figure 3:
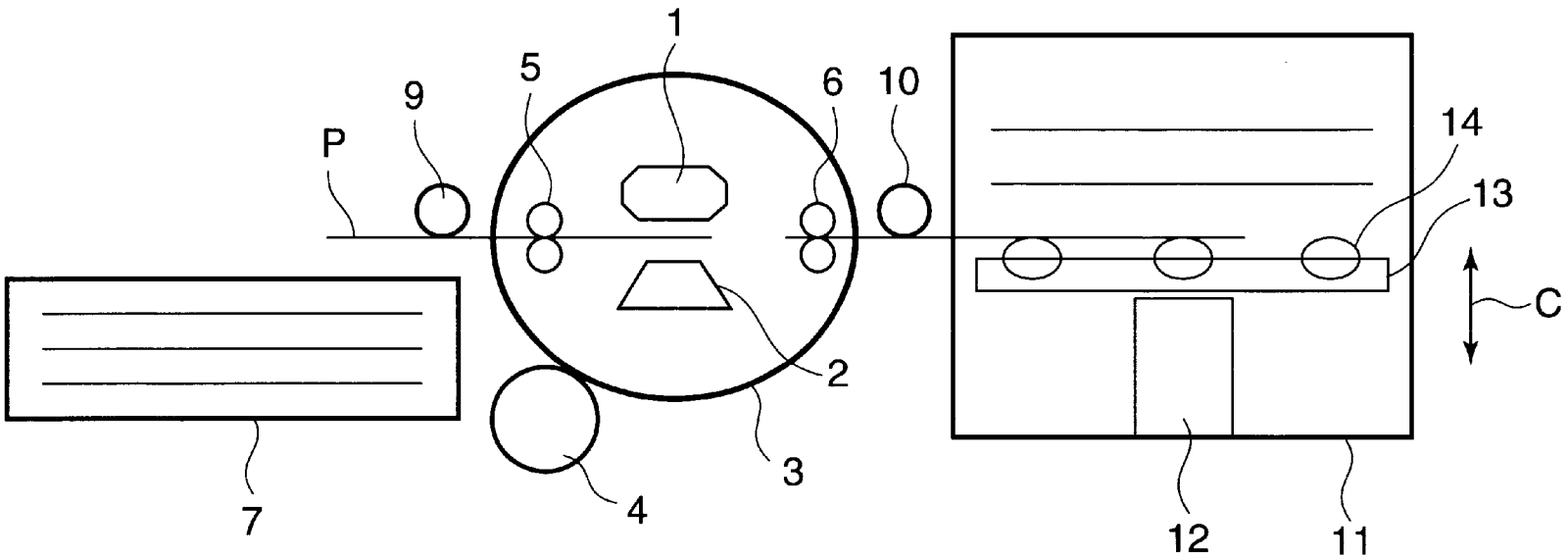
FIG. 3 is a schematic diagram showing a recording apparatus according to a second embodiment of the present invention.
Figure 4A:
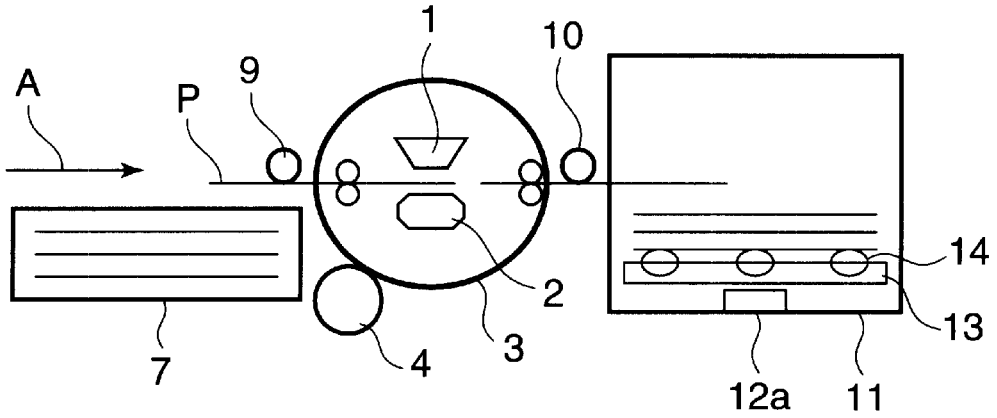
FIGS. 4A and 4B are diagrams illustrating a both-side recording operation.
Figure 4B:
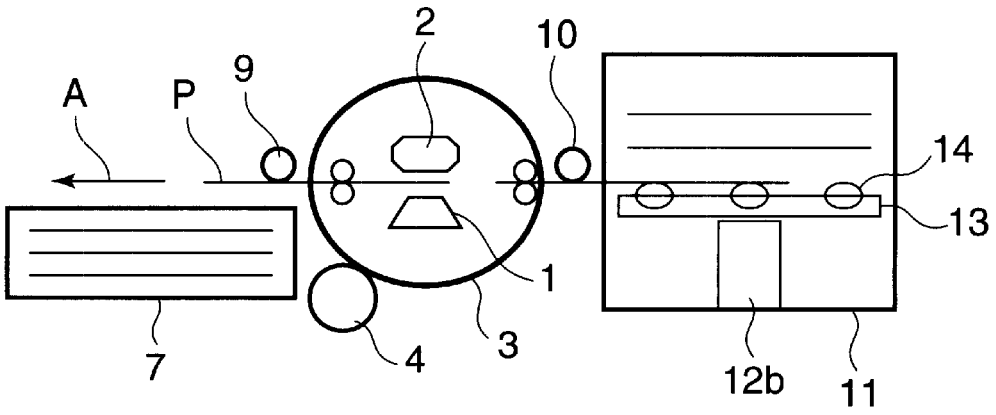

Next, the second embodiment of the recording apparatus of the present invention will be described with reference to the drawings. FIG. 3 is a schematic diagram showing the recording apparatus of the second embodiment, and FIGS. 4A and 4B are diagrams illustrating a both-side recording operation. The components which are substantially the same as those of the first embodiment are indicated by the same reference numerals, and a description of such components will be omitted. In this embodiment, images are collectively recorded on the first surfaces of a plurality of recording mediums, and then a reversal conveying means reversely conveys the recording mediums in the order in which the recording on the first surfaces has been conducted.

In the first embodiment described above, the reversal conveying means is formed only of the rotation roller 10. In this embodiment, in contrast, a sheet loading container 11 is provided instead of the sheet loading means 8, and the rotation roller 10 and the sheet loading container 11 constitute a reversal conveying means.

The sheet loading container 11 has a receiving plate 13 for receiving the recording mediums P, a support member 12 for vertically moving the receiving plate 13 (i.e., in the direction indicated by an arrow C), and rotation rollers 14 for conveying the recording medium P in contact with the receiving plate 13 for the recording mediums P toward the recording rotary unit 3.

In the above-described construction, when performing recording on the first surfaces of the recording mediums, the recording mediums P are conveyed by the rotation roller 9 from the sheet loading means 7 in the direction indicated by an arrow A to be fed to the recording rotary unit 3, as shown in FIG. 4A. And, images are recorded on the recording mediums P passing over the recording medium holding means 2 by the recording head 1, and the recording mediums are discharged by the rotation roller 10 toward the sheet loading container 11. At this time, the recording head 1 is positioned above the recording medium P, and the recording medium holding means 2 is positioned below the recording medium P, as shown in the drawing.

Here, the support member 12 in the sheet loading container 11 is downwardly contracted as indicated at 12*a*, and the recording mediums on whose first surfaces images have been recorded are loaded on the receiving plate 13 in the order in which recording has been performed.

When the recording on the first surfaces has been completed, the recording rotary unit 3 is rotated by approximately 180 degrees by the unit rotating means 4, as shown in FIG. 4B, whereby the recording head 1 is positioned below the recording medium P, and the recording medium holding means 2 is positioned above the recording medium P.

Here, the support member 12 in the sheet loading container 12 is extended as indicated at 12*b*, and the receiving plate 13 is upwardly moved to be substantially aligned with the position of the rotation roller 10. On the receiving plate 13, the recording mediums P on whose first surfaces recording has been effected are loaded from below in the order in which the recording has been conducted, so that by conveying the recording mediums P to the rotation roller 10 by using the rotation rollers 14 provided on the receiving plate 13, it is possible to reversely convey the recording mediums toward the recording rotary unit 3 in the direction indicated by the arrow B successively in the order in which recording on their first surfaces has been effected.

After image recording has been effected on the lower surfaces of the recording mediums, that is, on the second surfaces thereof, the recording mediums are discharged onto the sheet loading means 7 by the rotation roller 9.

Due to the above construction, it is possible to perform image recording collectively on the first surfaces of a plurality of recording mediums, and then perform recording collectively on the second surfaces thereof in the order in which the recording on the first surfaces has been conducted, whereby it is possible to avoid as much as possible the loss of time for fixing the recording material such as ink to the recording mediums or drying the same, thereby achieving an increase in recording speed.

Third Embodiment

Figure 5:
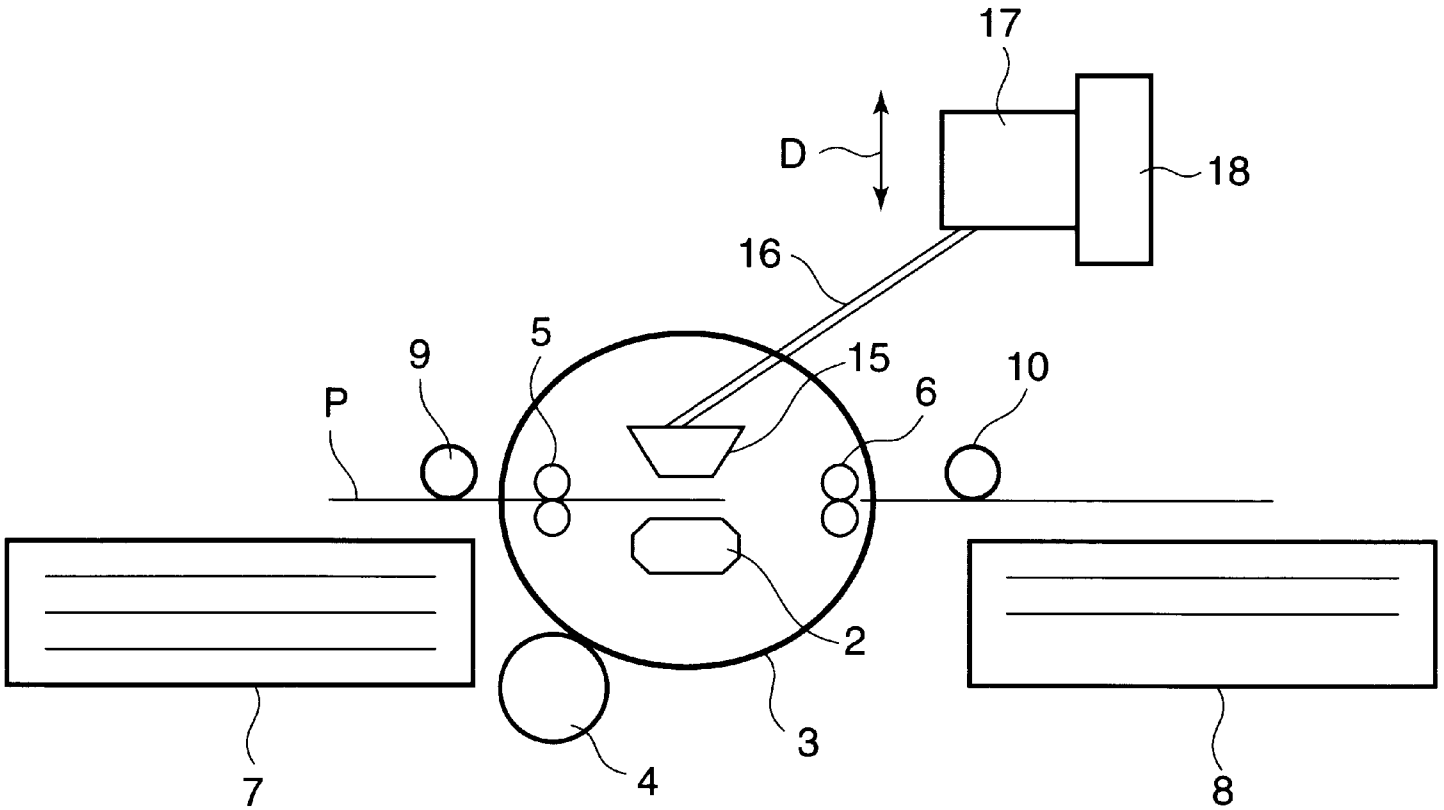
FIG. 5 is a schematic diagram showing a recording apparatus according to a third embodiment of the present invention.

Next, the third embodiment of the recording apparatus of the present invention will be described with reference to the relevant drawing. FIG. 5 is a schematic diagram showing the construction of a recording apparatus according to the third embodiment. The components which are substantially the same as those of the first embodiment are indicated by the same reference numerals, and a description of such components will be omitted. In this embodiment, the ink-jet recording system is employed for the recording head 15 serving as the recording means.

The recording head 15 of this embodiment is an ink-jet recording head, which is provided with an ink supply tube 16, an ink tank 17, and a pressure adjusting means 18 for adjusting the pressure with which ink is supplied to the ink supply tube 16. The pressure adjusting means 18 performs pressure adjustment by moving the ink tank 17 vertically (in the direction indicated by an arrow D).

By thus employing an ink-jet recording head, which easily allows a reduction in size and weight, as the recording means, it is possible to provide a small-sized recording apparatus capable of performing both-side recording.

Further, the ink tank 17 is moved vertically according to the vertical position of the recording head 15, which is varied as a result of the rotation of the recording rotary unit 3, whereby it is possible to adjust the pressure with which ink is supplied to the ink supply tube 16, thereby making it possible to mitigate the difference in recording quality between the upward recording and downward recording.

Recording Means

The ink-jet recording system adopted for the recording head 15 serving as the recording means will be described in detail. This recording head is provided with minute liquid ejection outlets (orifices), liquid passages, an energy acting portion provided in a part of each liquid passage, and an energy generating means for generating liquid droplet formation energy acting on the liquid in the energy acting portion.

Examples of the recording system to which this energy generating means is applied include a recording system using an electromechanical converting member such as a piezoelectric element, a recording system which uses an energy generating means causing heat generation through application of electromagnetic waves such as a laser and causing liquid droplets to be ejected by the action of the heat generation, and a recording system in which liquid is heated by an electrothermal converting member such as a heat generating element having a heat generating resistor and ejected.

In particular, the recording head used in the ink-jet recording system in which liquid is ejected by heat energy is capable of performing high-resolution recording since it allows high-density arrangement of the liquid ejection outlets (orifices) for ejecting recording liquid droplets to form ejection droplets. The recording head using an electrothermal converting member as the energy generating means is particularly advantageous in that it can be easily reduced in size, that it easily allows high-density mounting, and that it can be produced at low cost.

In this embodiment, electricity is supplied to the electrothermal converting member in response to a recording signal, and film boiling generated in the ink by the heat energy obtained through the electrothermal conversion is utilized to generate in the ink a bubble, which is caused to grow and contract, whereby ink is ejected from the ejection outlets to perform recording.

In the above-described construction, there are provided a recording rotary unit in which a recording means and a recording medium holding means are opposed to each other, and a rotating means for rotating the recording rotary unit, whereby it is possible to perform image recording on both sides of a recording medium by a single recording means without having to reverse the recording medium. Thus, there is no need to arrange a recording means on either side of the recording medium, whereby a reduction in apparatus cost can be achieved. Further, since there is no need to provide a means for reversing the recording medium, it is possible to achieve a reduction in apparatus size and an increase in recording speed.

What is claimed is:

1. A recording apparatus comprising:

conveying means for conveying a recording medium;

recording means for recording an image on the recording medium, said recording means being rotatable by rotating means; and recording medium holding means for holding the recording medium at a position opposed to said recording means, said recording medium holding means being rotatable with said recording means.

2. A recording apparatus according to claim 1, further comprising reversal conveying means for reversing the conveying direction of the recording medium.

3. A recording apparatus according to claim 2, wherein the reversal conveying means conveys recording mediums on whose first surfaces images have been recorded by said recording means in the order in which the recording has been performed.

4. A recording apparatus according to claim 1, wherein said recording means is rotated by approximately 180 degrees by said rotating means after an image has been recorded on the first surface of the recording medium.

5. A recording apparatus according to claim 1, wherein said recording means records an image by ejecting ink in accordance with signals.

6. A recording apparatus according to claim 5, wherein said recording means supplies electricity to an electrothermal converting member in accordance with a signal, and ejects ink by utilizing heat energy generated by the electrothermal converting member.

7. A recording apparatus according to claim 5, further comprising an ink supply tube, and pressure adjusting means for adjusting the pressure with which ink is supplied to said ink supply tube.

8. A recording method for performing recording on a recording medium by recording means, comprising the steps of:

arranging conveying means for conveying the recording medium;

arranging recording means for recording an image on the recording medium, the recording means being rotatable by rotating means;

arranging recording medium holding means for holding the recording medium at a position opposed to the recording means, the recording medium holding means being rotatable with the recording means;

arranging reversal conveying means for reversing the conveying direction of the recording medium;

performing recording on a first surface of the recording medium by the recording means;

rotating the recording means by approximately 180 degrees by the rotating means;

reversing the conveying direction of the recording medium by the reversal conveying means; and performing recording with the recording means on a second surface of the recording medium which is on the opposite side of the first surface thereof.

* * * * *